United States Patent [19]

Kiritani et al.

[11] 4,135,983

[45] Jan. 23, 1979

[54] METHOD FOR IMPROVING COKING PROPERTY OF COAL FOR USE IN PRODUCTION OF COKES

[75] Inventors: Yoshio Kiritani, Sennangun; Michio Tsuyuguchi, Wakayama, both of Japan

[73] Assignees: Kureha Kagaku Kogyo Kabushiki Kaisha; Sumikin Coke Co., Ltd., both of Japan

[21] Appl. No.: 535,025

[22] Filed: Dec. 20, 1974

Related U.S. Application Data

[62] Division of Ser. No. 213,037, Dec. 28, 1971, abandoned.

[30] Foreign Application Priority Data

| | | | |
|---|---|---|---|
| Dec. 28, 1970 | [JP] | Japan | 46-126248 |
| Dec. 29, 1970 | [JP] | Japan | 46-127536 |
| Jun. 1, 1971 | [JP] | Japan | 46-37978 |
| Jun. 1, 1971 | [JP] | Japan | 46-37979 |
| Oct. 22, 1971 | [JP] | Japan | 46-84259 |

[51] Int. Cl.[2] ..... C10B 57/04

[52] U.S. Cl. ..... 201/25; 201/21; 208/22

[58] Field of Search ..... 201/5, 6, 21, 25, 7, 201/8, 23; 208/22; 106/273 R, 280, 281 R, 284

[56] References Cited

U.S. PATENT DOCUMENTS

| | | | |
|---|---|---|---|
| 2,314,641 | 3/1943 | Wolf | 202/34 |
| 2,768,119 | 10/1956 | Nash | 196/14.11 |
| 3,562,783 | 2/1971 | Gorin | 201/6 |
| 3,692,663 | 9/1972 | Veda | 208/44 |
| 3,835,024 | 9/1974 | Veda | 208/22 |

*Primary Examiner*—Hiram H. Bernstein

*Attorney, Agent, or Firm*—Wenderoth, Lind & Ponack

[57] ABSTRACT

Raw material coal for coke production having improved coking property is readily obtainable by a simple step of blending raw material coal having poor coking property with a highly aromatic bituminous substance obtained by heat-treating hydrocarbons.

6 Claims, 2 Drawing Figures

Figure 1:
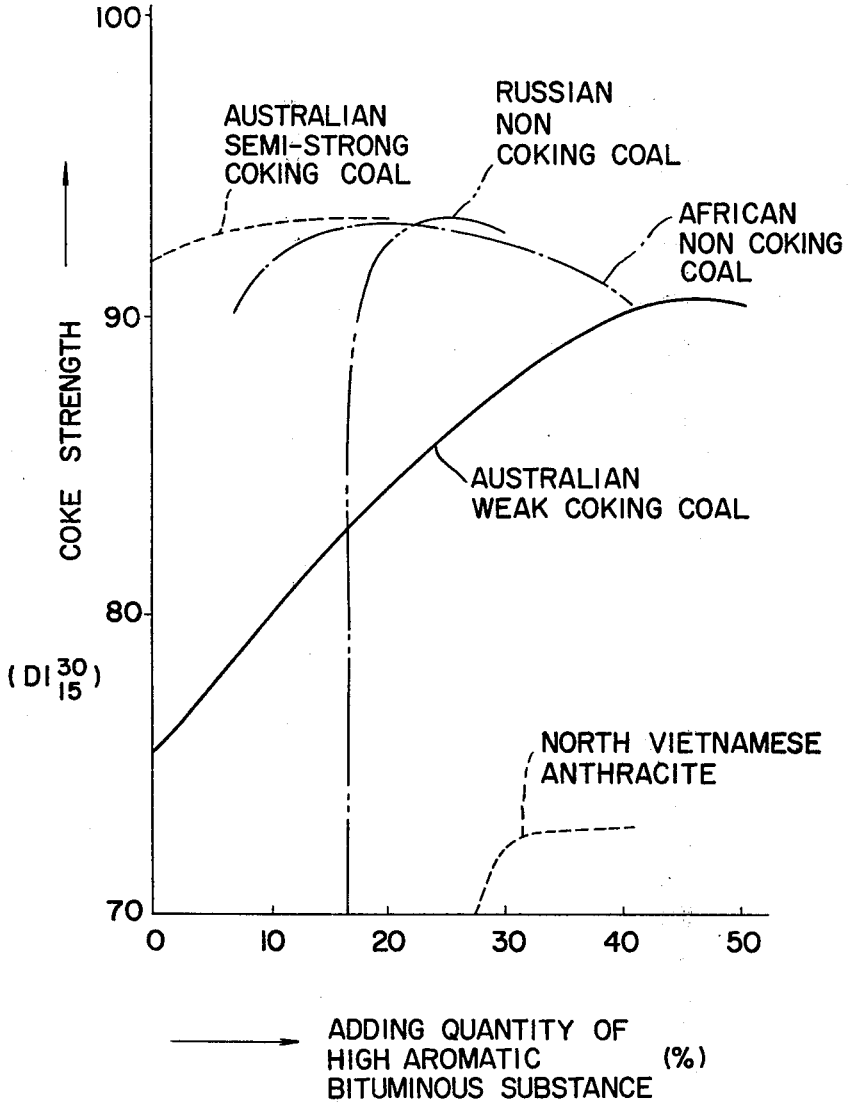

INVENTOR
Yoshio Kiritani
Michio Tsuyuguchi

BY Wenderoth, Lind & Ponack

ATTORNEYS

INVENTOR
Yoshio Kiritani
Michio Tsuyuguchi

BY Wenderoth, Lind & Ponack

ATTORNEYS

METHOD FOR IMPROVING COKING PROPERTY OF COAL FOR USE IN PRODUCTION OF COKES

This is a division, of application Ser. No. 213,037, filed Dec. 28, 1971, now abandoned.

This invention relates to a method for improving the coking property of raw material coal for use in the production of cokes, such coal being as non-coking coal, weak coking coal, or blended coal.

In recent years, development in the iron and steel industries all over the world has been remarkable. As the result of this, production of blister steel has rapidly increased, which necessitates installation of ever increasing numbers of blast furnaces of larger and larger scale. Such a remarkable increase in iron and steel production inevitably has caused rapid and enormous consumption of cokes in the blast furnaces that convert iron ores into pig iron, and the large scale blast furnaces strongly require that the quality of the cokes be highly durable.

Thus there has been an increasing demand for strongly coking coal of the high quality necessary for production of cokes having a sufficiently durable quality. On the other hand, there has arisen a serious problem of short supply of such strongly coking coal of high quality; the supply of such high quality raw material has not been up to the actual demand. This eventuates in an increased price of coking coal with the consequence that the iron and steel industries are compelled to lower the blending ratio of the high quality, strongly coking coal in the smelting operations, and that the quality of the cokes to be supplied to the blast furnaces, particularly, its strength as the indicator of its durability, is gradually lowered thus lowering the operating efficiency of the blast furnaces.

In order to satisfy the high demand for strongly coking coal, there have been attempts to reform the non-coking and weak coking coals by treating the same in an appropriate manner to turn them into a quality substantially equal to that of strongly coking coal necessary for producing cokes of durable quality.

For example, when coal having poor coking property such as weak coking coal is crushed and separated by a sieve into fine grain of 3 mm and below and coarse grain of 3 mm and above, the portion of the weak coking coal rich in the coking substance having good coking property is easily crushed into the fine grain to be collected under the sieve, while the portion of the coal containing an inert substance remains on the sieve owing to its being relatively hard and difficult to crush. By separating and removing the portion of the coal containing the inert substance which remains on the sieve and hinders the coking property thereof, and using the portion of the coal rich in the coking substance having good coking property, the coke strength improves. With this purification method, however, since the coarse grain coal left on the sieve cannot be effectively utilized, the economical loss is prohibitive.

It is also possible to improve the strength of the coke to be produced to some degree by crushing into fine grain even the portion of the weak coking coal containing the inert substance remaining on the sieve and uniformly dispersing such inert substance in the coal to be charged into the oven, i.e., adjusting the grade of the charging coal, but the improved coke is not equal to that obtained from strongly coking coal. Moreover, the bulk density of the charging coal within the chamber of the coke oven is reduced due to the increased ratio of the fine grain in the charging coal with the result that productivity of the coke oven is likely to be hindered.

Furthermore, with the so-called "dry charging method," wherein the coal to be charged into the coke oven is heated beforehand to reduce its moisture content below 6%, after which it is charged into the oven, the strength of the coke can be improved to some extent. However, this method entails a very large expenditure for the preheating or drying operation and increases environmental pollution due to the dust.

Also, an attempt has been made to obtain cokes of improved coke strength by adding to weak coking coal, etc. an agglutinating matter such as general coal tar pitch obtained by distillation of coal tar and having a softening point of from 40° C. to 100° C., then shaping the mixture into a desired form under pressure to make it a coal briquette, and finally carbonizing this coal briquette into formed coke. Or, at the time of preparing the charging coal, a portion or almost all of the weak coking coal in the raw material coal for preparing the charging coal is made into such briquettes and blended, with the remaining coal whereby the ratio of weak coking coal to the briquetted weak coking coal in the charging coal is reduced.

None of the above methods yields a coke equal to that obtained from U.S.A. high grade coking coal and the cokes so obtained cannot be said to have remarkably improved coking strengths.

Beside the above, there is also a method of improving the coking property of such non-coking or weak coking coal by first pulverizing such coal, then mixing general pitch with the coal in an amount of less than 70% by weight, and uniformly contacting the mixture with an inert gas maintained at a high temperature. However, even this method is not satisfactory on an industrial scale from the standpoint of operation and economy, since the mixture of coal and pitch must be in uniform contact with the high temperature inert gas.

It is therefore the primary object of the present invention to provide a method for improving the coking property of coal to be used for production of cokes, which is attained by adding an aromatic bituminous substance having a high softening point to raw material coal with or without addition of a hydrocarbon compound such as coal tar or road tar, thereby improving coal having a poor coking property to one having a high coking property substantially equal to that of strongly coking coal of high grade such as that produced in the U.S.A.

By the method of the present invention, it becomes possible to produce cokes of excellent quality, which are capable of taking the place of cokes derived from high priced, strongly coking coal present only in short quantity, by using non-coking or weak coking coal available in large quantity and at a low price, or coal having poor coking property remaining after crushing and sieving to remove the good coking portion of weak coking coal. It is further possible to improve coking property of blended coal for use in the coke production. Accordingly, the present invention brings a great deal of benefit into the coke manufacturing as well as the iron and steel manufacturing industries which are suffering from a shortage in supply of such high grade material coal.

The foregoing object and details of the present invention will become apparent from the following description when read in connection with the accompanying drawing as well as several preferred examples thereof.

Figure 2:
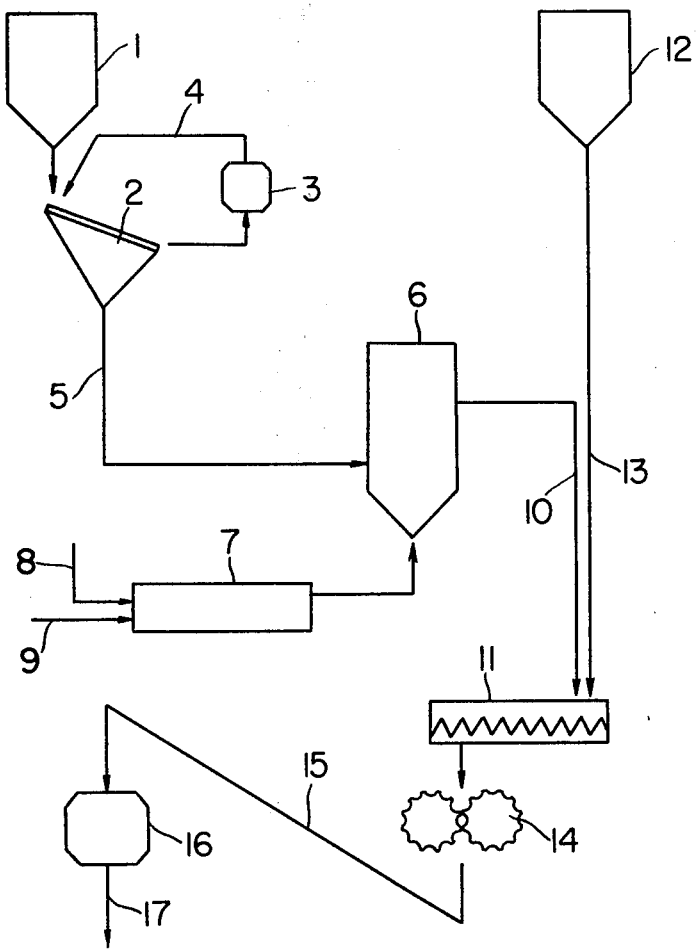

In the drawing:

FIG. 1 is a graphical representation showing the relationship between the coke strength of various kinds of coke and an added quantity of high aromatic bituminous substance, when the high aromatic bituminous substance is added to various kinds of raw material coal in an amount of from 5 to 50% by weight and then the mixture is subjected to the coking (or box) test in a coke oven; and FIG. 2 is a schematic diagram showing the actual process of changing the raw material coal into coal having high coking property.

The raw coals to be used in the present invention are as follows:

a. a non-coking or weak coking coal which is not suitable as the raw material for the production of cokes;

b. coal which contains therein a large amount of inert substance, hence has poor coking property, and which is obtained as an oversized product as distinguished from an undersized product of high coking property, when certain kinds of coal are crushed and sieved such as, for example, coals of Australian and Canadian origins; and c. blended coal for use in the coke production.

The bituminous substance to be used in the present invention is one having a hydrogen/carbon atomic ratio of 1.1 or below, a boiling point of 350° C. and above, a softening point range of from 100° C. to 400° C., and a fixed carbon content of from 40 to 80%. This substance can be obtained by heat-treating various sorts of petroleum oils and their distilled fractions such as naphtha, kerosene, light oil, fuel oil, asphalt, etc., or coal tar, road tar, tar pitch, and so forth. For example, this bituminous substance can be produced by first distilling ordinary coal tar produced at the time of dry distillation (or carbonization) of coal to remove therefrom light oil components having boiling points below 250° C., and heat-treating the residual low volatile, heavy oil. While the conditions for the heat-treatment depend on the class of the raw material oils, their properties, and the desired coking power, etc., maintenance of the heavy oil at a temperature range of from 400° C. to 450° C. for more than half an hour definitely achieves the intended purpose. Moreover, blowing of air into the raw material oil and addition of sulfur or other polymerization accelerators function to increase the effect of the heat-treatment.

The heavy oil as the raw material is not limited to the coal tar type heavy oils, but other heavy oil fractions such as asphalt can of course be used. It is also possible to use petroleum type heavy oils rich in aromatic component and produced as by-products in the petrochemical industries, or mineral oil pitch, coal tar pitch, etc. for electrode use which have already been reformed and given coke-improving property to some extent. For example, coke of remarkably improved coke strength can be obtained by adding to and mixing with raw material coal a high aromatic bituminous substance obtained by heat-treating an arbitrary liquid hydrocarbon oil, including crude petroleum oil, at a temperature of more than 900° C. at a first stage and further heat-treating a tarry substance resulted from the first stage process at a temperature range of from 250° C. to 550° C. at the second stage, and then dry-distilling (or carbonizing) the mixture of the coal and the high aromatic bituminous substance in a coke oven.

For the production of the aromatic bituminous substance of high softening point, the following three methods are recommended.

(1) Into a gaseous heat-transfer medium such as steam, burnt gas, etc. heated to a temperature of from 1,200° C. to 1,600° C., preheated and liquefied asphalt at a temperature of 300° C. or so is atomized and caused to contact the medium for a period of from 0.003 to 0.01 second at a reaction temperature of from 750° C. to 950° C. under a pressure in the vicinity of normal pressure, thereby to separate by distillation the desired aromatic bituminous substances from the mixture of the produced substances.

(2) A substantially non-reactive gaseous heat-transfer medium heated to a temperature of from 400° to 2,000° C. is caused to contact directly a raw material oil maintained at a temperature below the temperature of the gaseous heat-transfer medium and not exceeding 500° C. in a state wherein the heat transfer medium is dispersed in a continuous oil phase, thereby to fractionally distill the oil component to separate the bituminous substance; and (3) A petroleum type heavy oil, including asphalt, as the raw material is subjected to heat-treatment at a temperature range of 350° C. to 700° C. for a period of from 1 minute to 20 hours under a pressure of from normal pressure to 100 kg/cm$^2$, and the desired bituminous substance is separated by distillation, etc. from the mixture resulting from the heat-treatment.

Since the bituminous substance obtained by the aforementioned various methods comprises aromatic type compound having high molecular weights, it has remarkable affinity with the active component in the raw material coal with the consequence that dispersion and dissolution of alpha-compounds are accelerated to facilitate formation of a rigid coke wall, whereby coke having remarkably improved coke strength can be obtained. Also, when such aromatic bituminous substance is added at the time of producing coal briquettes, cokes of higher coke strength than that produced by using heretofore known general tars and pitches of various sorts can be produced.

If the aromatic bituminous substance of high softening point an appropriate liquid hydrocarbon oil such as coal tar or road tar is added and the mixture then added to the aforementioned non-coking or weak coking coal, the quantity of the aromatic bituminous substance can be reduced with a yet favorable result. Also, when hydrocarbon compounds in the form of tar or pitch and having a softening point lower than the softening point of the aromatic bituminous substance is added, such hydrocarbon compound can be mixed under a temperature condition which is lower than the softening point of the aromatic bituminous substance to be added and mixed. In other words, when such coal tar or road tar is added to and mixed with the non-coking or weak coking raw material coal along with the abovementioned aromatic bituminous substance of high softening point, the surface of the raw material coal has an increase affinity for the aromatic bituminous substance of high softening point which has been added thereto, while the aromatic bituminous substance forms a mutual dissolved matter due to dissolution of a portion thereof into the coal tar or road tar added thereto. Thus, through the intimate combination of the raw material coal and the aromatic bituminous substance of high softening point, more rigid cokes than those produced by adding only the aromatic bituminous substance of high softening point are obtainable, which causes a remarkable difference in improving the coke strength in the actual coke production.

The effect to be attained from addition of such aromatic bituminous substance of high softening point to the raw material coal or further addition of the hydrocarbon compounds such as coal tar or road tar can be remarkably exhibited when such additives are used for coal having poor coking property which is separated from an under-sized product having good coking property and left on a sieve as an over-sized product. Such coal is obtained, for example, from coal of Australian and Canadian origin that is subjected to screening by use of a sieve to classify fine grain of less than 10 mm and coarse grain of more than 10 mm, or more preferably, fine grain of less than 3 mm and coarse grain of more than 3 mm, wherein the fine grain portion generally contains components having good coking property, and the coarse grain portion contains inert substance of poor coking property. That is, since the raw material coal of the Australian and Canadian origin contains therein components having differentiated coking properties according to the grain size distribution, if such raw material coal is sieved into an appropriate size adapted to its property, and the portion of slightly coking coal or weakly coking coal containing a large quantity of inert substance, hence poor coking property, is classified and removed as the over-sized product, the coking property of the fine grain portion of the raw material coal obtained as the under-sized product is obviously improved. On the other hand, however, as the slightly coking or weakly coking coal classified and removed as the over-sized product possesses the coking property to some extent, when it is mixed with the abovementioned aromatic bituminous substance of high softening point to be rendered into coke, a strength coke can be produced owing to the fundamental combination of the two substances with the result that the thus treated coal possesses a better property as the raw material for coke than that obtained by mixing ordinary non-coking matter and the abovementioned aromatic bituminous substance of high softening point.

Furthermore, when 95–60 parts by weight of inferior coals having poor coking property and crushed to the grain size of approximately 3 mm and below, or more preferably below 2 mm, and 5–40 parts by weight of the abovementioned aromatic bituminous substance of high softening point are sufficiently mixed under a temperature condition which is higher than the softening point of the aromatic bituminous substance and then the resulting mixture product is crushed to an appropriate grain size adapted to preparation of charging coal for the coke oven in accordance with the ordinary method of crushing coals, the coking property of the mixed product can be improved to a level equal to that of strongly coking coal of U.S. origin. The reason for such a remarkable improvement in the coking property is that, since the aromatic bituminous substance of high softening point comprises aromatic type compounds having high molecular weights, it has high affinity for the active component in the coal, so that, when it is mixed with heated coal, or when it is mixed with coal and subjected to heat-treatment, the abovementioned aromatic bituminous substance of high softening point becomes molten and tightly adheres to the surface of the coal grain or penetrates thereinto. Accordingly, even at the time of the crushing, the aromatic bituminous substance of high softening point does not separate from the coal grain, but sufficiently melts at the time of the coking process to cover the inferior coal grain existing in the charging coal for the coke oven to produce homogeneous and strong cokes.

If further necessary, the mixture of the abovementioned raw material coal and the aromatic bituminous substance of high softening point is hot-formed under pressure, whereby the aromatic bituminous substance further penetrates into the coal grains. In addition, by this shaping of the mixture, handling of the product becomes extremely easy thereafter.

For the purpose of enabling skilled persons in the art to practise the present invention, the following preferred examples are presented. It should, however, be noted that these examples are illustrative only, and that any change and modification may be made within the ambit of the invention as afforded by the appended claims. For the sake of simplicity, the abovementioned aromatic bituminous substance of high softening point will hereinafter be called "bituminous substance of the present invention".

EXAMPLE 1

Coking tests (or box tests) were conducted on the mixture of raw material coal and the bituminous substance of the present invention with or without further addition of coal tar or road tar in accordance with the following experimental schemes.

1. non-coking coal crushed to a grain size of 3 mm under having the free swelling index (FSI) of "1" and showing no coking at the box test on the single coal in accordance with the test method prescribed in the Japanese Industrial Standard JIS M-8801-5-3;
2. weakly coking coal crushed to a grain size of 3 mm under having the free swelling index (FSI) of "2" and the coke strength at $DI_{15}^{30}$ (drum test index in accordance with JIS K-2151-6-2) of 42.6 in the box test; and
3. the bituminous substance of the present invention rich in the optical anisotropy, having a softening point of 186° C. as measured by the ring and ball method in accordance with JIS K-2421, and obtained by heat-treating a non-volatile, heavy oil remaining after removal of light oil fractions of a boiling point of 250° C. and below at the coal tar distillation at a temperature of 425° C. for about 1 hour.

The abovementioned bituminous substance of the present invention was added to and mixed with each of the abovementioned non-coking coal and weak coking coal at a mixing ratio of 5, 10, 20, and 30%, respectively.

In addition, coal tar and road tar having the properties as shown in the following Table 1 were respectively added to and mixed with each of the prepared mixtures of the bituminous subsance and the coal at a mixing ratio of 10%, respectively.

Table 1

| | Boiling point (° C) | Softening point (° C) | Sulfur content (%) |
|---|---|---|---|
| Coal tar | above 180 | below normal temp. | 0.4 |
| Road tar | above 260 | 30 | 0.4 |

Each of the abovementioned mixtures of coal, the bituminous substance, and tar or pitch was subjected to the box tests in accordance with JIS (Japanese Industrial Standard), as the result of which the coke strengths of the respective mixtures were obtained as shown in the following Table 2.

Table 2

| | Mixing ratio of the instant bituminous substance (%) | Coke strength of coal added with instant bituminous substance alone ($DI_{15}^{30}$) | Coke strength of coal added with both instant bituminous substance and road tar ($DI_{15}^{30}$) | Coke strength of coal added with both instant bituminous substance and coal tar ($DI_{15}^{30}$) |
|---|---|---|---|---|
| Non-coking coal | 0 | not coked | not coked | not coked |
| | 5 | " | " | " |
| | 10 | 54.6 | 58.3 | 57.2 |
| | 20 | 72.3 | 75.4 | 74.6 |
| | 30 | 87.9 | 88.1 | 87.6 |
| Weak coking coal | 0 | (42.6) | — | — |
| | 5 | 48.6 | 51.3 | 50.9 |
| | 10 | 81.6 | 82.8 | 81.7 |
| | 20 | 92.3 | 93.2 | 92.8 |
| | 30 | 93.4 | 93.7 | 93.1 |

As is apparent from the above Table 2, not only when the bituminous substance of the present invention is not added to the non-coking coal, but also when it is added to the coal at the mixing ratio of 5%, the coal is not shown to have been coked. However, when more than 10% of the bituminous substance is added to the non-coking coal, the coke strength of the coal is shown to have been improved with increase in the quantity thereof.

At the coking test with a mixture of the non-coking coal, the bituminous substance, and 10% of road tar or coal tar, the coke strength generally found to be superior to that of the non-coking coal added with the bituminous substance alone. However, when the quantity of the bituminous substance becomes 30%, there can be recognized almost no difference in the coke strength between the coal with the bituminous substance alone and that with the bituminous substance and the road tar or coal tar.

Also, in the coking tests with a mixture of the weak coking coal and the bituminous substance of the present invention, it was found that the coke strength improved with increase in the added quantity of the bituminous substance. When the road tar or coal tar was further added to the mixture of the weak coking coal and the bituminous substance, the coke strength was shown to be higher in the case of adding the road tar or coal tar than in the case of adding the bituminous substance alone, provided that when the added quantity of the bituminous substance is 30%, there can be recognized almost no difference in the coke strength between the coal with the bituminous substance alone and that with the bituminous substance and the road tar or coal tar.

It is therefore understood from this Example 1 that the coking property of the non-coking or weak coking coal can be remarkably improved by addition of the bituminous substance of the present invention, and that the effect of addition of the coal tar or road tar diminishes with an increase in the added quantity of the bituminous substance of the present invention, although there takes place a remarkably different aspect when the coal with tar and bituminous substance is blended with various kinds of raw material coals to be used for running the coke oven as will be explained in Example 2 below.

EXAMPLE 2

20% of the bituminous substance of the present invention having a softening point of 186° C. and obtained by the method as described in Example 1 above was added to the non-coking coal crushed to a grain size of 3 mm under also as mentioned in Example 1 above, to which mixture the road tar was added at the respective ratios of 5, 10, and 15% by weight, thereby to prepare "modified coal A."

Next, to the abovementioned non-coking coal, the bituminous substance of the present invention alone was added at the respective ratios of 20, 30, and 50%, thereby to prepare "modified coal B."

These modified coals were substituted for a portion of the strongly coking coal that is a part of the ordinary blended raw material coal for the coke oven operation, and the respective blended coals were subjected to the coking test in accordance with the prescription of the JIS. The resulted coke strength of each of the coals is shown in the following Table 3.

Table 3

| Blended coals | Blending ratio | Basic blending ratio % | Modified coal A prepared by adding 20% of instant bituminous substance and road tar to non-coking coal Adding quantity of road tar 5% | 10% | 15% | Modified coal B prepared by adding only the instant bituminous substance to non-coking coal Adding quantity of instant bituminous substance 20% | 30% | 50% |
|---|---|---|---|---|---|---|---|---|
| Strongly coking coal | | 30 | 25 | 25 | 25 | 25 | 25 | 25 |
| Semi-strongly coking coal | | 40 | 40 | 40 | 40 | 40 | 40 | 40 |
| Weak coking coal | | 30 | 30 | 30 | 30 | 30 | 30 | 30 |
| Modified coal A | | — | 5 | 5 | 5 | — | — | — |
| Modified coal B | | — | — | — | — | 5 | 5 | 5 |
| | Total | 100 | 100 | 100 | 100 | 100 | 100 | 100 |
| Coke strength $Di_{15}^{30}$ | | 92.8 | 90.8 | 92.6 | 92.8 | 87.6 | 89.8 | 92.5 |

It is clear from the above Table 3 that, when 5% of the total 30% of the strongly coking coal is replaced by modified coal A, the coke strength thereof is somewhat lowered in comparison with that of the coal containing the basic blending ratio of 30% of the strongly coking coal. However, when modified coal A with 10% and 15% respectively of the road tar replaces 5% of the abovementioned strongly coking coal, the coke strengths of the produced cokes is found to be substantially equal to the coke strength of the coke having the basic blending ratio of the strongly coking coal of 30%.

However, when the modified coal B replaces 5% of the abovementioned strongly coking coal, it is seen that a coke strength close to that of the coke containing the basic blend of the strongly coking coal can be attained with the modified coal B with 50% of the bituminous substance of the present invention.

That is, when modified coal A, prepared by adding to the non-coking coal the bituminous substance of the present invention as well as the road tar, is mixed with the blended raw material coal for the coke oven operations, generally more durable coke then that produced by adding modified coal B added can be obtained.

EXAMPLE 3

Australian coal — South Bulli — was screened by a mesh sieve of 3 mm. The slightly coking or weakly coking portion obtained as the oversized product and the strongly coking portion obtained as the under-sized product were subjected to the coking test in accordance with the prescription in the Japanese Industrial Standard (JIS).

The same coking (box) test was carried out on low volatile, strongly coking coal of the U.S. origin — Keyston —. The test results are as shown in the following Table 4.

Table 4

| | US Keyston | Australian South Bulli | | |
|---|---|---|---|---|
| | Single | Single | under-size | over-size |
| Free Swelling Index (FSI) | 9 | 7 | 8 | 2 |
| Coke strength at $DI_{15}^{30}$ | 93.6 | 92.8 | 94.0 | 87.0 |

Coal tar was subjected to fractional distillation to recover the non-volatile, heavy oil having a boiling point of 250° C. and above. This heavy oil was heat-treated at a temperature of from 400° to 450° C. for a period of from 0.5 to 1.5 hours to produce the bituminous substance of the present invention. The properties of the substance are as shown in the following Table 5.

Table 5

| | Specimen No. | 1 | 2 | 3 | 4 | 5 | 6 |
|---|---|---|---|---|---|---|---|
| Heat-treating condition | Temp. (° C) | 400 | 450 | 400 | 450 | 400 | 450 |
| | Time (min.) | 30 | 30 | 60 | 60 | 90 | 90 |
| Softing Point (° C) | | 120 above | 160 above | 150 above | 210 above | 180 above | 245 above |
| Boiling Point (° C) | | 310 | 410 | 410 | 410 | 410 | 410 |
| Benzene insoluble component (%) | | 25 | 29 | 28 | 33 | 30 | 41 |
| Fixed carbon (%) | | 48 | 51 | 50 | 60 | 54 | 63 |

3 parts by weight of the abovementioned bituminous substance as designated by the specimen Nos. 2, 4, and 6, respectively, were added to and mixed with 7 parts by weight of the weak coking portion obtained as the over-sized product from the abovementioned Australian coal "South Bulli" to prepare the modified coal, which was then subjected to the JIS-prescribed coking test, the results of which are shown in the following Table 6. The coking property is recognized to be substantially equal to the US strongly coking coal "Keyston".

Table 6

| | 1 | 2 | 3 |
|---|---|---|---|
| Specimen No. in Table 5 | 2 | 4 | 6 |
| Free Swelling Index (FSI) | 7½ | 7½ | 8 |
| Coke strength at $Di_{15}^{30}$ | 91.8 | 93.0 | 93.5 |

EXAMPLE 4

The Australian coal — South Bulli — was screened by a mesh sieve of 3 mm to obtain weak coking coal as the over-sized product. This weak coking coal was mixed with the bituminous substance of the present invention as designated by the specimen No. 6 in the above Table 5 at various mixing ratios of from 5 to 50% by weight. The thus obtained modified coals were subjected to the JIS-prescribed coking (box) test.

Also, 7 parts by weight of weak coking coal of the Japanese origin called "Akabira" and 3 parts by weight of the abovementioned modified coal were mixed together, and subjected to the same coking test.

The test results are shown in the following Table 7.

Table 7

| | | US* | Adding Quantity of Instant Bituminous Substance (%) | | | | | | |
|---|---|---|---|---|---|---|---|---|---|
| | | Keyston | 5 | 10 | 20 | 30 | 35 | 40 | 50 |
| Modified coal (single) | FSI | (9) | 4½ | 8 | 9 | 9 | 9 | 7 | 6 |
| | $DI_{15}^{30}$ | (93.6) | 91.2 | 92.4 | 93.6 | 93.5 | 93.0 | 92.1 | 88.3 |
| Blend of modified coal (3) and Akabira (7) | FSI | (8) | 5 | 7 | 8 | 8 | 7 | 6 | 6 |
| | $DI_{15}^{30}$ | (82.1) | 90.2 | 91.8 | 93.4 | 93.0 | 86.5 | 83.6 | 81.6 |

Note: *test results for the purpose of comparison

As is evident from the above Table, the single modified coal having a coking property substantially equal to that of the US strongly coking coal can be obtained by adding from 5 to 40% by weight of the bituminous substance of the present invention.

In the case of blended coal of 70% of "Akabira" and 30% of the modified coal, the coking property and the coke strength substantially equal to those of the US strongly coking coal can be obtained by adding from 10% to 30% by weight of the bituminous substance of the present invention.

EXAMPLE 5

The following Table 8 indicates properties of the raw material coal used in this Example.

Table 8

| Pank | Brand | Approximate analyses: Volatile matter | Ash | Fixed carbon | FSI |
|---|---|---|---|---|---|
| US LV strongly coking coal | USA "Keyston 38 | 16.6 | 5.9 | 76.4 | 8 |
| | USA "Itman" | 17.4 | 7.0 | 74.8 | 8 |
| Strongly coking coal | Canada "Balmer" | 20.1 | 12.0 | 66.7 | 8 |
| | Australia "Coal Cliff" | 20.8 | 10.8 | 67.3 | 3 |
| Semi-strongly coking coal | USA "Daviss" | 27.6 | 6.7 | 64.5 | 8 |
| | Austrailia "Black Water" | 26.2 | 8.7 | 63.8 | 3 |
| | " "Wallon Dilly" | 28.2 | 10.4 | 59.9 | 3 |
| | USA "Irish Eagle" | 28.0 | 10.9 | 59.8 | 8 |
| Weak coking coal | Canada "Wethered "Balmer" | 20.5 | 12.5 | 65.6 | 3 |
| | Australia "Newdell" | 39.5 | 6.3 | 53.0 | 2½ |
| | Japanese "Akabira" | 40.9 | 7.4 | 50.2 | 5½ |
| Non-coking coal | Russia "OS" | 15.2 | 7.5 | 76.1 | 1 |

First of all, the blended coal was subjected to the JIS-prescribed coking (box) test without additives thereto. (designated as "Known Method 1").

To the abovementioned blended coal, a pitch obtained from coal tar, having a softening point of 71° C., and crushed to a grain size of 2 mm was added and mixed at the respective adding quantity of 2, 5, and 8% by weight. Then, the raw material coal was subjected to the JIS-defined coking (box) test. (designated as "Known Method 2").

To the abovementioned blended coal, the bituminous substance of the present invention having extremely high aromaticity and the properties as shown in the following Table 9 which is obtained by heat-treating at a temperature range of from 300° to 400° C. a tarry substance resulted from heat-treatment of crude ore of the Seria origin at a temperature of 1,200° C. for a period of 0.06 second, and crushing the treated substance into a grain size of approximately 2 mm was added and mixed at a mixing ratio of 2, 5, and 8% by weight, respectively. The mixed raw material coal was then subjected to the same coking (box) test. (designated as "Instant Method")

Table 9

| Boiling point (° C) | Softening point (° C) | Sulfur content (%) | Fixed carbon (%) | H/C atomic ratio |
|---|---|---|---|---|
| 460 | 210 | 0.6 | 60.3 | 0.55 |

The coking test was conducted under a condition that the raw material coal was charged into a box at a predetermined density in accordance with JIS, and then placed in a coke oven for dry-distillation (or carbonization).

The tested cokes were compared for their coking property, the results of which are shown in the following Table 10.

Table 10

| | Blending ratio of blended coal (wt. part) | | Additives and their adding quantity wt% | | Coke strength of produced coke ($DI_{15}^{30}$) |
|---|---|---|---|---|---|
| Known method (1) | US LV strongly coking coal | 13 | | | |
| | Strongly coking coal | 16 | | | |
| | US semi-strongly coking coal | 14 | | | |

Table 10-continued

| | Blending ratio of blended coal (wt. part) | | Additives and their adding quantity wt% | | Coke strength of produced coke ($DI_{15}^{30}$) |
|---|---|---|---|---|---|
| | Aust. semi-strongly coking coal | 22 | — | 91.4 | |
| | Aust. weak coking coal | 11 | | | |
| | US weak coking coal | 8 | | | |
| | Japanese coal | 16 | | | |
| | " | | pitch | 2 | 91.4 |
| Known method (2) | " | | pitch | 5 | 91.7 |
| | " | | pitch | 8 | 91.0 |
| Instant method | " | | aromatic bituminous substance | 2 | 92.0 |
| | " | | aromatic bituminous substance | 5 | 92.3 |
| | " | | bituminous substance | 8 | 92.5 |

It is clear from the above Table that the coke produced by adding the bituminous substance of the present invention to the blended raw material coal has a coke strength at $DI_{15}^{30}$ of from 0.6 to 1.1 higher than that of the coke product without addition of such additive. On the other hand, the coke produced by adding pitch to the blended raw material coal is not much different from the coke obtained from the blended raw material coal without additive.

EXAMPLE 6

To the blended coal of the same blending ratio as in Example 5, the bituminous substance of the present invention as shown in Table 9 of the Example 5 was added and mixed, after which coal tar was further added and mixed to the raw material. The coking (box) test was conducted under the same condition as in Example 5 with the results as shown in the following Table 11.

Table 11

| Adding quantity of instant bituminous substance (wt %) | Adding quantity of coal tar (wt %) | Coke strength $DI_{15}^{30}$ |
|---|---|---|
| 2 | 2 | 92.7 |
| 3 | 3 | 92.6 |

When the coke obtained by adding to the blended raw material coal both the bituminous substance of the present invention and coal tar is compared with the coke obtained by adding the bituminous substance alone to the blended coal (cf. Table 10), it is seen that the coke strength of the former improves by 0.7 at $DI_{15}^{30}$, when the adding quantity of the bituminous substance is equal to 2%, this value being higher than that in the case of adding 8% of such bituminous substance by itself.

The reason for this increased coke strength is considered to be due to the improved dispersion of the bituminous substance of the present invention by addition of liquid hydrocarbon compounds such as coal tar. Hence the addition of coal tar contributes to improvement in the coke strength as well as a reduction in the adding quantity of the bituminous substance of the present invention.

EXAMPLE 7

To the blended raw material coal at a blending ratio as shown in the following Table 12, in which crushed non-coking coal containing 80% of 3mm under-sieve, 100% of 3mm under-sieve, and 100% of 2mm under-sieve, respectively, is blended, the bituminous substance of the present invention having the properties as shown in Table 9 was added and mixed, and then the mixture was subjected to the coking test (box test) as in Example 5.

On the other hand, weak coking coal (weathered Balmer coal) crushed to a grain size of 80% of 3 mm under-sieve, and 100% of 2 mm under-sieve, respectively, was blended with the abovementioned blended coal in place of the non-coking coal present therein. To this blended coal, the bituminous substance of this invention having the same properties as in Table 9 above was added, and the mixed raw material was subjected to the coking test. The results are shown in Table 12 below.

Table 12

| Blending Ratio Rate of Coals (wt. part) | | Crushed Product and Grain Size | Adding Qty. of Instant Bituminous Substance (wt. %) | Coke Strength $DI_{15}^{30}$ |
|---|---|---|---|---|
| US LV strongly coking coal | 8 | non-coking 5% 3mm under 80% | — | 89.8 |
| Strong coking coal | 16 | | | |
| US semi-strongly cokig coal | 14 | | | |
| Australian semi-strongly coking coal | 22 | | | |
| Australian weak coking coal | 8 | | | |
| Japanese coal | 16 | | | |
| Non-coking coal | 5 | | | |
| " | | " | 1.5 | 91.2 |
| " | | non-coking 5% 3mm under 100% | — | 89.7 |
| " | | " | 1.5 | 91.6 |
| " | | non-coking 5% 2mm under 100% | — | 89.9 |
| " | | " | 1.5 | 92.1 |
| US LV strongly coking coal | 8 | Canadian weak coking 3mm under 5% 80% | — | 89.6 |
| Strongly coking coal | 16 | | | |
| US semi-strongly coking coal | 14 | | | |
| Australian semi-coking coal | 22 | | | |
| Australian weakcoking coal | 8 | | | |
| Japanese coal | 16 | | | |
| Canadian weak coking coal | 5 | | | |
| " | | " | 1.5 | 90.9 |
| " | | Canadian weak coking 2mm under 5% 100% | — | 89.7 |
| " | | " | 1.5 | 91.8 |

It is seen from the above Table that the coke produced by adding the bituminous substance of the present invention to the blended coal, in which a portion or all of the non-coking or weak coking coal crushed to a grain size of 3 mm under-sieve, or more preferably, 2 mm under-sieve, is blended, is shown to have an improved coke strength by 1.3 to 2.2 at $DI_{15}^{30}$ in comparison with the coke produced without addition of the bituminous substance of the present invention.

The thus produced coke is seen to have a further improved degree of coke strength as compared to that of of the coke obtained by adding the bituminous substance of the present invention and tar or pitch to the blended raw material coal of Examples 5 and 6 above. This signifies that the effect of the bituminous substance added to the blended coal is remarkably heightened when a portion or all of the non-coking or weak coking coal to be blended with the raw material coal is crushed to a fine grain size of 2 mm and below.

EXAMPLE 8

Australian "Yarrabee" coal and African "Swaziland" coal having the respective properties as shown in Table 13 were mixed together at a mixing ratio of 1:1. After the total quantity of the mixed raw material coal were crushed into a grain size of 3 mm or below, a pitch having the properties as shown in the following Table 14 which has been obtained from coal tar and crushed to a grain size of about 2 mm was mixed with the abovementioned crushed raw material coal at the respective mixing ratio of 5, 10, and 20% by weight, thereafter the blended coal was heated to a temperature of 75° C. and then shaped into coal briquettes of a dimension of 35 mm × 35 mm × 20 mm by means of a double roll briquetting machine under pressure of 1.5 tons/cm.

Also, to the abovementioned crushed raw material coal, there was added to the bituminous substance of the present invention having the properties as shown in Table 14, which was produced by heat-treating crude oil of the Seria origin at a temperature of 1,200° C. for 0.06 second, further heat-treating the resultant tarry substance at a temperature range of from 300 to 400° C., thereafter crushing the resulted product to a grain size of about 2 mm. The adding quantity of this bituminous substance to the raw material coal is 5, 10, and 25% by weight, respectively. The blended coal was then heated to a temperature of 240° C. and shaped into coal briquettes by the abovementioned briquetting machine under the same condition.

Subsequently, the abovementioned respective coal briquettes were buried in hot sand which was preheated to 500° C., and then carbonized by an electric furnace maintained at a temperature of 1,000° C. for 30 minutes, after which the coal briquettes were taken out of the furnace, extinguished, and cooled, thereby obtaining the formed coke having the properties as shown in the following Table 15.

Table 13

| | Approximate Analyses | | | |
|---|---|---|---|---|
| | Volatile matter | Ash | Fixed | F. S. I. |
| Russian "O. S." | 15.2 | 7.5 | 76.1 | 1 |
| Australian "New Castle" | 32.1 | 10.0 | 55.8 | 1 |
| Australian "Yarrabee" | 9.0 | 8.1 | 81.7 | 1 |
| African "Swaziland" | 15.8 | 6.6 | 76.4 | 4 |

Table 14

| | Boiling Point | Softening point | H/C ratio | Fixed Carbon |
|---|---|---|---|---|
| Pitch | 320° C | 72° C | 0.65 | 38% |
| Instant bituminous substance | 460° C | 210° C | 0.55 | 60.3% |

Table 15

| | No. | Additive | Forming temp. (° C) | Adding Qty. of Additive (wt. %) | Pressure With stand of Coal Briquette (kg/cm²) | Coke strength ($DI_{15}^{30}$) |
|---|---|---|---|---|---|---|
| Known method | 1 | Pitch | 75 | 5 | 48.6 | 48.0 |
| | 2 | " | " | 10 | 95.3 | 73.1 |
| | 3 | " | " | 20 | 135.6 | 92.6 |
| Instant Method | 4 | Instant bituminous substance | 240 | 5 | 42.6 | 72.4 |
| | 5 | " | " | 10 | 88.3 | 93.4 |
| | 6 | " | " | 25 | 118.8 | 94.8 |

From Table 15, it is evident that the strength of the formed coke with the bituminous substance of the present invention is remarkably improved in comparison with the formed coke produced by adding ordinary tar pitch.

EXAMPLE 9

Australian "New Castle" coal shown in Table 13 above was crushed to a grain size of 3 mm and below, to which the abovementioned pitch and bituminous substance crushed to a grain size of 2 mm and below was added thereto at a varying quantity of addition. The mixed raw material coal was then shaped into coal briquettes by a double roll briquetting machine under pressure of 1.5 tons/cm. Subsequently, the abovementioned coal briquettes containing differing quantities of the additives were carbonized under the same treating conditions as in Example 8 above to obtain formed cokes of properties as shown in the following Table 16.

Further, to the abovementioned "New Castle" coal was added tar and a mixture of the tar and the bituminous substance of the present invention, which was shaped into coal briquettes under pressure, and then carbonized. The formed coke thus obtained was found to have the properties as shown in Table 17 below.

Table 16

| | No. | Additive | Forming Temp. (° C) | Adding Qty. of Additive (wt %) | Coke strength ($DI_{15}^{30}$) |
|---|---|---|---|---|---|
| Known method | 7 | — | 75 | — | 85.8 |
| | 8 | Pitch | " | 3 | 88.7 |
| | 9 | " | " | 5 | 90.5 |
| | 10 | " | " | 10 | 94.4 |
| Instant method | 11 | Instant bituminous substance | " | 3 | 89.8 |
| | 12 | " | " | 5 | 92.7 |
| | 13 | Pitch and instant bituminous substance | " | 3<br>3 | 94.5 |
| | 14 | " | " | 5<br>5 | 95.8 |

Table 17

| | No. | Additive | Forming Temp. (° C) | Adding Qty. of Additive (wt. %) | Coke strength ($DI_{15}^{30}$) |
|---|---|---|---|---|---|
| Known method | 15 | Tar | Normal temp. | 3 | 87.2 |
| | 16 | " | " | 10 | 91.2 |
| | 17 | Tar and | " | 5 | 94.1 |

Table 17-continued

| | No. | Additive | Forming Temp. (° C) | Adding Qty. of Additive (wt. %) | Coke strength ($DI_{15}^{30}$) |
|---|---|---|---|---|---|
| Instant method | 18 | instant bituminous substance<br>" | " | 5 | 95.3 |
| | 19 | " | | 5<br>10 | 94.3 |
| | 20 | | | 3<br>10<br>5 | 95.1 |

It is understood from the above Table 17 that the coke produced by adding to the abovementioned raw material coal both the bituminous substance of the present invention and tar or pitch, then shaping the raw material into a coal briquette under pressure and carbonizing, the thus formed coal briquette possesses greatly improved coke strength in comparison with the formed coke produced by adding tar or pitch alone to the raw material coal, shaping into coal briquette, and carbonizing.

EXAMPLE 10

Blended raw material coal having the same blended composition as that of the charging coal as shown in Table 18 below was crushed to a grain size of 3mm and below, to which road tar or a mixture of the road tar and the bituminous substance of the present invention having the properties as shown in Table 14 above was added, and the mixed raw material was shaped into coal briquettes under pressure. The thus obtained coal briquette was mixed with the abovementioned charging coal, and then subjected to the coking test (box test) in accordance with the prescription of the Japanese Industrial Standard. The test results are as shown in the following Table 18.

Table 18

| Blending ratio of coals (wt. part) | Mixing of Qty. coal Briquette (%) | Additives and Adding Qty. (wt. %) | Coke strength ($DI_{15}^{30}$) |
|---|---|---|---|
| US LV strongly coking coal 14<br>Australian strongly coking coal 14<br>US semi-strongly coking coal 14<br>Australian semi-strongly coking coal 27<br>Australian weak coking coal 20<br>Japanese coal 11 | 0 | — | 91.3 |
| " | 20 | road tar 5 | 92.0 |
| " | 20 | road tar 5 | 92.1 |
| " | 20 | road tar 5<br>instant bituminous substance 5 | 92.5 |

Table 18-continued

| Blending ratio of coals (wt. part) | Mixing of Qty. coal Briquette (%) | Additives and Adding Qty. (wt. %) | Coke strength ($DI_{15}^{30}$) |
|---|---|---|---|
| " | 20 | road tar 5<br>instant bituminous 10 substance | 92.8 |

It is clear from the above Table 18 that, when carbonizing a mixture of ordinary charging coal and coal briquette, the coke produced by mixing the charging coal with the coal briquette obtained by blending the raw material coal with the bituminous substance and road tar, and shaping the same into a coal briquette under pressure shows a high improvement in the coke strengh by 0.5–0.8 at $Di_{15}^{30}$ in comparison with the coke produced by mixing the charging coal with the coal briquette formed by blending road tar alone.

EXAMPLE 11

A bituminous substance A having properties as shown in Table 19 below was produced by heat-treating crude oil of Seria origin at a temperature of 1,200° C. for 0.06 second to obtain a tarry substance therefrom, and further heat-treating this tarry substance at a temperature range of from 300° to 400° C.

Also, another bituminous substance B of the properties as shown in Table 19 below was produced by ejecting at a rate of 120 kg/hr asphalt obtained as a distillation residue of crude oil of Khafuji origin into a reactor having an inner diameter of 50 mm and a height of 800 mm, and lined with refractory brick, into, which as super-heated steam approximately 1,350° C. which is produced in a regenerative and reversible heating system, is continuously introduced at a rate of 400 kg/hr to decompose it under substantially normal pressure for a time instant of about 0.005 second, and rapidly cooling the reacted substance, from which the bituminous substance B was obtained as a residue of 450° C. and above as converted at a normal pressure.

These bituminous substances A and B were totally crushed into grain size of 2 mm and below, and added to various sorts of coal as shown in Table 20 below crushed to a grain size of 3 mm under which size occupies approximately 80% of the entire grain size distribution at a ratio of from 5 to 50% by weight depending on the properties of each raw material coal. The mixed raw material was then subjected to the coking test.

The relationship between the strength of the thus produced coke and the adding quantity of the respective bituminous substances is as shown in FIG. 1, from which it can be concluded that, while the added quantity of the bituminous substance depends on the properties of the raw material coal to be modified, a range of from 5 to 50% by weight is the optimum quantity.

Table 19

| | Instant Bituminous Substance (A) | Instant Bituminous Substance (B) |
|---|---|---|
| Boiling Point (° C) | 460 | 467 |
| Softening Temp. (° C) | 210 | 210 |
| Sulfur (%) | 0.6 | 5.6 |
| Fixed Carbon (%) | 60.3 | 60.8 |
| H/C ratio | 0.55 | 0.72 |
| Added Coals | Russian non-coking coal, North-Vietnam anthracite, Australian weak coking coal | African non-coking Coal, Australian semi-strong coking coal |

Table 20

| Coal \ Property | Approximate Analyses | | | |
|---|---|---|---|---|
| | Ash (%) | Volatile Matter (%) | Fixed carbon (%) | F S I |
| Australian weak coking coal | 8.9 | 38.3 | 52.8 | 4 |
| Russian non-coking coal | 8.4 | 15.2 | 76.4 | 1 |
| Australian semi-strongly coking coal | 9.5 | 29.1 | 61.4 | 3 |
| African non-coking | 11.2 | 15.3 | 73.5 | 2 |
| North-Vietnam anthracite | 8.4 | 6.8 | 84.8 | hot coked |

EXAMPLE 12

Raw material coal of a standard blend composed of 25% of US strongly coking coal "Keyston," 55% of Australian semi-strongly coking coal "Black Water," and 20% of Japanese weak coking coal "Akabira" was subjected to the coking (box) test in a coke oven.

Next, Russian non-coking coal as shown in Table 20 above and the bituminous substance A of the present invention were entirely crushed to a grain size of 2 mm under. 80 parts by weight of this Russian non-coking coal was heated to 260° C., to which 20 parts by weight of the abovementioned bituminous substance A was added and sufficiently mixed, whereby modified coal was obtained. This modified Russian non-coking coal was then crushed to a grain size of 3 mm under, the grain size of which occupied about 90% of the entire size distribution.

Three coking tests were conducted in each of the following cases:

(a) The modified Russian non-coking coal was blended with raw material coal in substitution for the US strongly coking coal "Keyston";

(b) A simple mixture of 80 parts by weight of the abovementioned Russian non-coking coal not subjected to heating and 20 parts by weight of the bituminous substance A of the present invention was blended with raw material coal in substitution for the US "Keyston"; and (c) The Russian non-coking coal was singly blended with raw material coal in substitution for the US "Kenston".

The strength of the produced cokes is shown in the following Table 21.

Table 21

| | Blending ratio | | Test No. | 1 | 2 | 3 | 4 | Average | Difference from blended "Keyston" |
|---|---|---|---|---|---|---|---|---|---|
| Basic Blend | Keyston | 25 | $DI_{15}^{30}$ | 93.7 | 92.9 | 93.5 | 92.3 | 93.1 | — |
| | Black Water | 55 | | | | | | | |
| | Akabira | 20 | | | | | | | |
| Blended with | Modified Russian non-coking coal | 25 | $DI_{14}^{30}$ | 93.4 | 94.0 | 94.1 | 93.5 | 93.8 | + 0.7 |

Table 21-continued

| | Blending ratio | Test No. | 1 | 2 | 3 | 4 | Average | Difference from blended "Keyston" |
|---|---|---|---|---|---|---|---|---|
| modified coal Blended with simple mixture | Balck Water | 55 | | | | | | |
| | Akabira | 20 | | | | | | |
| | Russian non-coking coal | 20 | $DI_{15}^{30}$ 93.5 | 91.7 | 94.1 | 93.4 | 93.2 | + 0.1 |
| | Bituminous substance (A) | 5 | | | | | | |
| | Black Water | 55 | | | | | | |
| | Akebira | 20 | | | | | | |
| | Russian Non-coking coal | 25 | $DI_{15}^{30}$ 92.4 | 91.5 | 91.9 | 91.4 | 91.9 | − 1.2 |
| | Black Water | 55 | | | | | | |
| | Akabira | 20 | | | | | | |

The coke produced by blending the Russian modified coal with the raw material coal in substitution for the US "Keyston" is shown to have an improved coke strength by 0.7 at $DI_{15}^{30}$ higher than that of the coke produced from the standard blend of raw material coal, in which "Keyston" is blended. However, the coke produced from blended coal using a simple mixture of the non-heated Russian non-coking coal and the bituminous substance A in substitution for "Keyston" is not much different from the coke produced from the raw material coal blended with "Keyston."

EXAMPLE 13

Blended coal for test purpose was prepared based on two kinds of blending recipes No. 1 and No. 2 as shown in Table 22 below, and the respective blended coals were subjected to the coking test same as in Example 11.

Table 22

| Coal | Recipe No. | 1 | 2 |
|---|---|---|---|
| Strongly Coking coal | Beatrice | 13 % | 0 % |
| | Balmer | 7 % | 7 % |
| | South Balli | 6 % | 6 % |
| | Grundy | 20 % | 20 % |
| Semi-strongly Coking coal | | | |
| | Wallondilly | 18 % | 18 % |
| | Black Water | 13 % | 13 % |
| | Lidell | 9 % | 9 % |
| Weak coking coal | | | |
| | Miike | 14 % | 14 % |
| Modified non-coking coal | Modified Russian non-coking coal | 0 | 13 % |
| | (Russian non-coking coal) | — | (80)% |
| | (Bituminous substance A) | — | (20)% |

NOTE: The numerical figures in the parentheses denote the mixing ratio of the Russian non-cooking coal used for producing the modified coal and the bituminous substance A of the present invention used for producing the modified coal.

The blending recipe No. 1 is an example of the blending ratio, when preparing ordinary charging coal for the coke oven.

The blending recipe No. 2 is a blending ratio, in which a modified Russian non-coking coal is used in place of the strongly coking coal "Beatrice." The preparation of the modified Russian non-coking coal is as follows: the bituminous substance A of the present invention as shown in Table 19 and the Russian non-coking coal as shown in Table 20 are entirely crushed to a grain size of 2 mm under, after which 80 parts by weight of Russian non-coking coal and 20 parts by weight of the bituminous substance A of the present invention are blended and heated to a temperature of 240° C., while sufficiently mixing them; the thus obtained modified Russian non-coking coal is then shaped into coal briquette of a dimension of 35 mm × 35 mm × 20 mm under heat and linear pressure of 1.5 tons/cm by means of a double-roll briquetting machine, and the thus produced coal briquette is crushed to a grain size of 3 mm under, the grain size of which occupies about 90% of the entire size distribution.)

The strength of the respective cokes is as shown in Table 23 below.

Table 23

| Test No. | Recipe No. 1 $DI_{15}^{30}$ | Recipe No. 2 $DI_{15}^{30}$ |
|---|---|---|
| 1 | 92.8 | 92.9 |
| 2 | 93.0 | 93.6 |
| 3 | 93.5 | 93.7 |
| Average | 93.1 | 93.4 |

From the above Table, it is apparent that the coke produced from the blended coal according to the blending recipe No. 2, in which the US strongly coking coal "Beatrice" is replaced by for the modified Russian non-coking coal, possesses an average coke strength of 93.4 at $DI_{15}^{30}$ at $DI_{15}^{30}$, which is an increase of 0.3 contrasted to the strength of the coke produced from the ordinary blended coal of the recipe No. 1, which averages 93.1. This signifies that the modified coal produced in accordance with the method of the present invention is sufficiently modified to such an extent that it can be used in perfect substitution for the US strongly coking coal.

EXAMPLE 14

Blended coal for test purposes was prepared based on five kinds of blending recipes No. 3 to No. 7 inclusive as shown in Table 24 below, and the respective blended coals were subjected to coking tests in a coke oven.

Table 24

| Brand | | Recipe No. 3 | 4 | 5 | 6 | 7 |
|---|---|---|---|---|---|---|
| Strongly Coking coal | Keyston | 13 | 8 | 8 | 3 | 3 |
| | Balmer | 7 | 7 | 7 | 7 | 7 |
| | South Bulli | 6 | 6 | 6 | 6 | 6 |
| Semi-strongly coking coal | Pitzton | 8 | 8 | 8 | 8 | 8 |
| | Grundy | 8 | 8 | 8 | 8 | 8 |
| | Black Water | 15 | 15 | 15 | 15 | 15 |
| | Wallondilly | 10 | 10 | 10 | 10 | 10 |
| Weak coking coal | Lidell | 9 | 9 | 9 | 9 | 9 |
| | Miike | 14 | 14 | 14 | 14 | 14 |
| | Akabira | 10 | 10 | 10 | 10 | 10 |
| | Modified Africa | — | 5 | — | 10 | — |

Table 24-continued

| Brand | Recipe No. 3 | 4 | 5 | 6 | 7 |
|---|---|---|---|---|---|
| non-coking coal (African non-coking coal) | — | (80) | — | (80) | — |
| (Bituminous Substance B) | — | (20) | — | (20) | — |
| Simple mixture | — | — | 5 | — | 10 |
| (African non-coking coal) | — | — | (80) | — | (80) |
| (Bituminous substance B) | — | — | (20) | — | (20) |
| Coke strength $DI_{15}^{30}$ | 93.2 | 93.5 | 93.0 | 93.4 | 92.3 |

NOTE:
The numerical figures in the parentheses denote the mixing ratio of the African non-coking coal and the bituminous substance B of the present invention used for production of the modified coal as well as preparation of a simple mixture.

The blending recipe No. 3 shown an example of the blending ratio in preparing ordinary charging coal.

The blending recipe No. 4 shows a blending ratio, in which the modified African non-coking coal is used in place of the US strongly coking coal "Keyston" by replacing 5% out of the 13% of the "Keyston" with this modified African non-coking coal. (The manner of preparing this modified African non-coking coal is as follows: the bituminous substance B shown in Table 19 above and the African non-coking coal shown in Table 20 above are entirely crushed to a grain size of 2 mm under, after which 80 parts by weight of the African non-coking coal and 20 parts by weight of the bituminous substance B of the present invention are blended and heated to a temperature of 260° C., while sufficiently mixing them; and the thus obtained modified African non-coking coal is then crushed to a grain size of 3 mm under, the grain size of which occupies about 90% of the entire size distribution.)

The blending recipe No. 5 shows a blending ratio, wherein a simple mixture of the abovementioned African non-coking coal and the bituminous substance B of the present invention, both being crushed to a grain size of 2 mm under, are blended together at a ratio of 80 : 20 parts by weight, but not heat-treated, replaces 5% out of the total 13% of the US "Keyston."

The blending recipe No. 6 shows a blending ratio, wherein the abovementioned modified African non-coking coal containing therein about 90% of the grain size distribution of 3 mm under replaces 10% out of the total 13% of the US "Keyston."

The blending recipe No. 7 shows a blending ratio, in which the abovementioned simple mixture of the African non-coking coal and the bituminous substance B substitutes 10% out of the total 13% of the US "Keyston."

As is clear from the bottom row of the Table 24, the cokes produced from the blended coal of the recipe No. 4 and the recipe No. 6 are shown to have coke strengths of 93.5 and 93.4, respectively, at $DI_{15}^{30}$, which is an increase of from 0.2 to 0.3 in comparison with coke produced from the blended coal of the recipe No. 3 which has a coke strength of 93.2 at $DI_{15}^{30}$. On the other hand, however, the cokes produced from the blended coals of recipe No. 5 and recipe No. 7 are shown to have coke strengths of 93.0 and 92.3, respectively, at $DI_{15}^{30}$, which are decreases of 0.2 and 0.9 in comparison with the coke produced from the blended coal of recipe No. 3 which has a coke strength of 93.2 at $DI_{15}^{30}$.

The above-noted results signify that the modified coal produced in accordance with the method of the present invention possesses high fluidity at the time of heating, as does the US strongly coking coal, due to which the coal sufficiently melts in the course of the coking process to coat the inferior coal particles existing in the blended coal, thereby to form homogeneous and strong coke.

In the following, one actual operational embodiment of the method according to the present invention will be described hereinbelow with reference to FIG. 2.

Raw material coal to be modified is temporarily stored in a bin 1. The coal is then screened by a sieve 2 to a grain size of 3 mm under, or more preferably 2 mm under, and over-sized product is crushed by a crusher 3, after which the crushed raw material is fed back to the sieve 2 through an appropriate conveying means 4. On the other hand, the under-sized product is transferred by an appropriate conveying means 5 and charged into a fluidized heating furnace 6, where it is heated to a temperature higher by approximately 30° C., for example, than the softening temperature of the bituminous substance of the present invention to be added to the raw material coal. Incidentally, the fluidized heating furnace is operated by high temperature combustion exhaust gas produced in a combustion furnace 7 where fuel gas 8 and air 9 are mixed and burnt, and then charged into the the furnace. The raw material coal heated in the fluidized heating furnace is led into a mixing apparatus 11 by way of an appropriate transfer means 10, where it is blended at a required mixing ratio with the bituminous substance according to the present invention having a crushed grain size of 2 mm under, which is fed from a bin 12 through a supply passage 13. As soon as the bituminous substance is mixed with the heated raw material coal in the mixing machine 11, it promptly melts and uniformly and intimately adheres to and impregnates into each of the coal particles due to its affinity with the molten component in the coal, whereby the raw material coal is turned into modified coal having high fluidity at the time of heating. The modified coal thus produced is then discharged from the mixing machine 11, and press-shaped into coal briquett by means of a double roll briquetting machine 14, whereby he bituminous substance of the present invention further increases its adhesion to the coal particles because of the pressure. The modified coal shaped in briquettes for easy handling is transferred by a conveying means 15 up to a crusher 16 where it is crushed to a required grain size in an ordinary manner of coal crushing, and forwarded to a blending system through a passage 17.

Use of the modified coal in its solid or briquette form provides less effect it primarily possesses. The maximum blending effect than can be advantageously attained by finely crushing the same as is the case with US strongly coking coal.

Since the bituminous substance according to the present invention uniformly and intimately adheres to the coal particles, it does not separate therefrom even at the time of crushing with the consequence that it sufficiently melts to coat low grade coal particles existing in the charging coal in the course of the coking process, whereby uniform and strong coke can be formed.

As stated in the foregoing, according to the method of the present invention, blending of raw material coal and the bituminous substance of the present invention can be carried out in an extremely simple manner as is the case with oridinary coal blending operations, hence there will be no necessity for providing any special apparatus and installation for improving the coke strength as in the case of producing coal briquettes or dry charging coal. Moreover, according to the present invention, raw material coal, particularly an inferior coal can be modified into one having a substantially equal coke strength to that of US strongly coking coal, and can be used in substitution therefor, which can greatly alleviate the shortage in such strongly coking coal.

What we claim is:

1. A method for improving the coking property of coal for producing blast furnace coke, which comprises:

(a) heat-treating heavy oil from the distillation of coal tar and free from light oil components of a boiling point below 250° C. at a temperature of from 400 to 450° C. for a period of from 0.5 to 1.5 hours, thereby producing a bituminous substance; and (b) blending said bituminous substance with raw material coal in an amount effective to increase the coking power of the raw material coal, said raw material coal being selected from the group consisting of non-coking coal, weakly coking coal, and a mixture of both.

2. The method as claimed in claim 1, wherein said bituminous substance has a softening point of 100 to 400° C., an H/C atomic ratio of 1.1 and below, a boiling point of 350° C. and above, and a fixed carbon content of from 40 to 80%.

3. A method according to claim 1 wherein the bituminous substance is used in an amount of at least 5% by weight.

4. A method according to claim 1 wherein coal tar or road tar is added to the raw material coal together with said bituminous substance in amounts effective to further increase the coking power of the raw material coal.

5. A method according to claim 1 wherein the raw material coal is first screened through a sieve having a mesh size of less than 10mm and the oversized particles are mixed with the bituminous substance.

6. A method according to claim 1 wherein the bituminous substance is blended with the raw material at temperatures above the softening point of the bituminous substance.

* * * * *